US005511046A

United States Patent [19]

Vanderpal

[11] Patent Number: 5,511,046

[45] Date of Patent: Apr. 23, 1996

[54] RECORDABLE TIMEPIECE

[76] Inventor: Geoffrey A. Vanderpal, 13 Wagner Dr., Cary, Ill. 60013

[21] Appl. No.: 64,965

[22] Filed: May 20, 1993

[51] Int. Cl.[6] ..... G04B 21/08

[52] U.S. Cl. ..... 368/63

[58] Field of Search ..... 368/63, 72–73, 368/243–256, 272–273, 274

[56] References Cited

U.S. PATENT DOCUMENTS 3,835,640 9/1974 Hughes, Jr. .
4,408,096 10/1983 Washizuka et al. .
4,508,457 4/1985 Aizawa .
4,701,862 10/1987 Washizuka et al. .
4,717,261 1/1988 Kita et al. .
4,821,247 4/1989 Grooms .

OTHER PUBLICATIONS

Talking Day Planner. May 1993 Sharper Image Catalog.

*Primary Examiner*—Bernard Roskoski
*Attorney, Agent, or Firm*—Michael Best & Friedrich

[57] ABSTRACT

A recording/reproducing electronic timepiece apparatus which is capable of recording a voice or other audible signal wherein the voice is played back at the preset alarm time. The apparatus is an improvement over other such devices inasmuch as it utilizes microprocessor technology to control all functions of the alarm set and triggering of the alarm as well as the control of the input and output of digitized audio signals.

6 Claims, 2 Drawing Sheets

RECORDABLE TIMEPIECE

BACKGROUND OF THE INVENTION

This invention relates to the area of timepiece devices, and more particularly those which are capable of recording a voice or other audible signal for playback when an alarm set is triggered. Although such devices are already seen on the market today, and are described in U.S. Pat. No. 4,508,457 issued Apr. 2, 1985 to Aiawa and U.S. Pat. No. 4,717,261 issued Jan. 5, 1988 to Kita, et al., the present invention device disclosed herein represents an improvement over such prior art devices in that it uses microprocessor technology to control the setting and triggering of the alarm, as well as the signal digitizing of the audible signal, the addressing of the digitized signal into storage, and the processing of the digitized signal from storage and into an audible facsimile of the original input signal.

The use of a microprocessor to control such functions results in a variety of improvements over the individual logic components shown in the aforementioned patents. One advantage of using a microprocessor is the dependence of interrupts to check keypad and register status rather than the polling method as described in U.S. Pat. No. 4,717,261. The polling method is much more demanding of battery consumption, which is a consideration where the timekeeping apparatus involved is a travel alarm or wrist watch and the power source is a battery.

Another advantage to the use of a microprocessor is that the LCD (liquid crystal diode) driver/controller can be built into the microprocessor so that the LCD display can have an unlimited amount of flexibility as opposed to the methods described in the two aforementioned patents which are hardware devices and completely inflexible.

Moreover, because a microprocessor is used, a continuous power source is not required to maintain voice and memory data. This becomes a distinct advantage where the timekeeping apparatus is a travel alarm or wrist watch and the power source is a battery. Also, unlike the devices disclosed in the two aforementioned patents, external SRAM or DRAM memory is not required because the microprocessor contains ROM and the voice or audible sound may be stored in an analog EEPROM.

And finally, in the two aforementioned patents, because a microprocessor is not used, the hardware must be preset to specify a particular set of input/output rates of addressing analog signals into the memory, which results in limited predetermined record times. With the present invention, the input/output rate into the memory storage can be varied to suit the amount of memory present in the device so that appropriate record/playback times may be set.

SUMMARY OF THE INVENTION

The present invention anticipates a voice recordable time keeping device where all functions, namely, the LCD driver/controller, the sound digitizer, the digitized signal storage method, the method for transforming the digitized sound into a facsimile of input audio signal, the alarm, the snooze function and clock itself are all controlled by a microprocessor. This results in a great number of advantages over the prior art in that the device disclosed herein is much more flexible in terms of operation and functionality.

As mentioned in the Background, above, the present invention uses an interrupt method of detecting changes in keypad status which is preferable over the polled method.

With the interrupt method, there is immediate response time, less power drain from the power source or battery, and potentially much higher reliability.

Therefore, it is an object of the present invention to utilize a microprocessor as an LCD driver/controller so as to allow for an infinite variety of display capabilities.

It is a further object of the present invention to utilize a microprocessor to control recordable timepiece circuitry that storage and retrieval rates of a digitized audio signal can be varied to suit the amount of memory storage present in the device and the requirements of the user for sound quality.

It is still a further object of the present invention to utilize a microprocessor to control recordable timepiece circuitry to eliminate the need for external SRAM or DRAM memory.

And it is yet a further object of the present invention to utilize a microprocessor to control recordable timepiece circuitry by using an interrupt method to detect changes in keypad and register status to provide for immediate response time, less power source consumption with potentially higher reliability.

It is also an object of the present invention to provide a microprocessor to control recordable timepiece circuitry such that either a voice and/or a tone may be produced when an alarm is triggered. Because a microprocessor is used, the tone can be of infinite variety.

These, and other advantages of the present invention can be readily determined from following detailed description of the drawings and the drawings present herein.

DETAILED DESCRIPTION OF THE DRAWINGS

Figure 1:
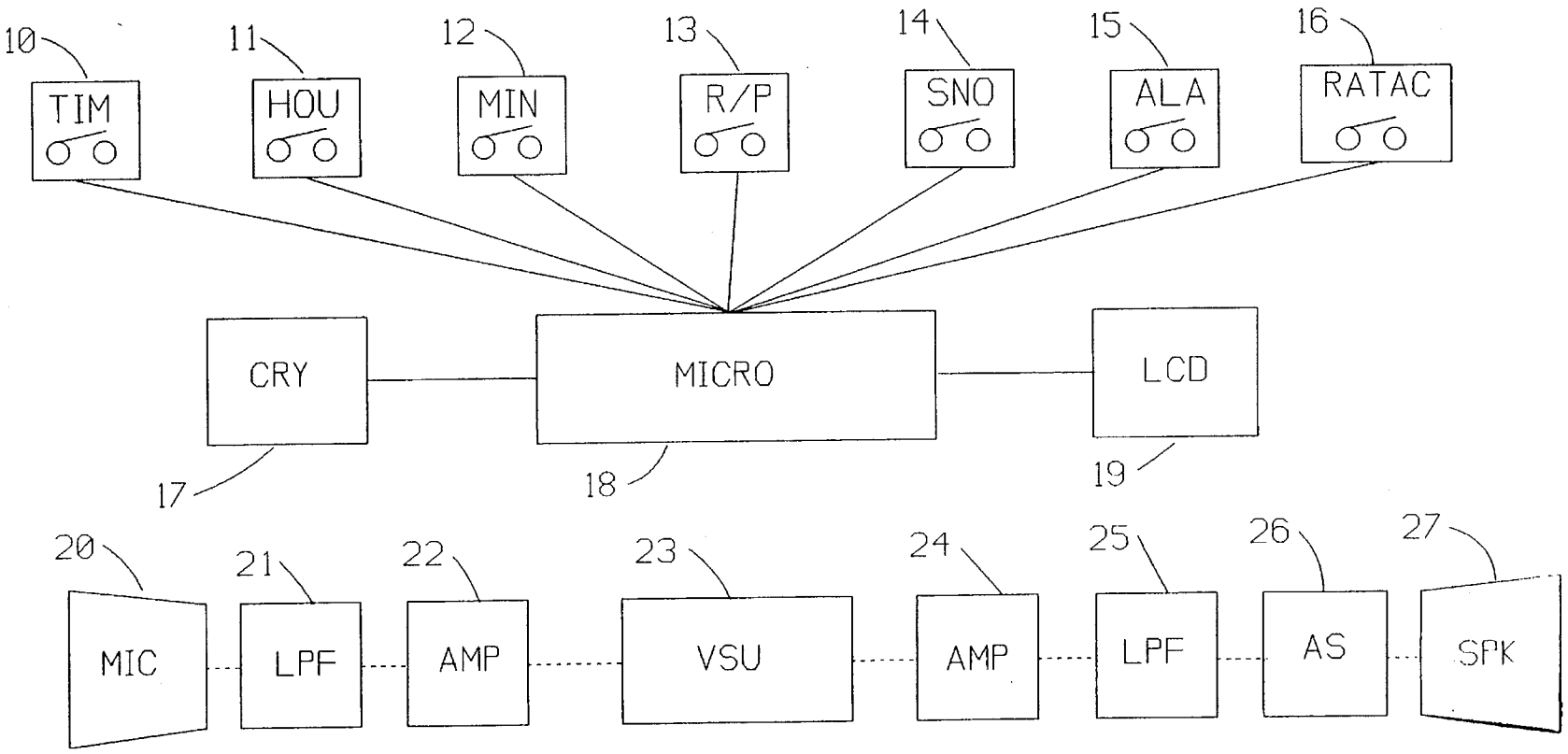
FIG. 1 is a block diagram of the elements an electronic recording/reproducing timepiece utilizing microprocessor.

Referring now to the diagram shown in FIG. 1, there is seen the present invention which discloses the use of a microprocessor to control all electronic elements present in a recording/reproducing timepiece.

Figure 2:
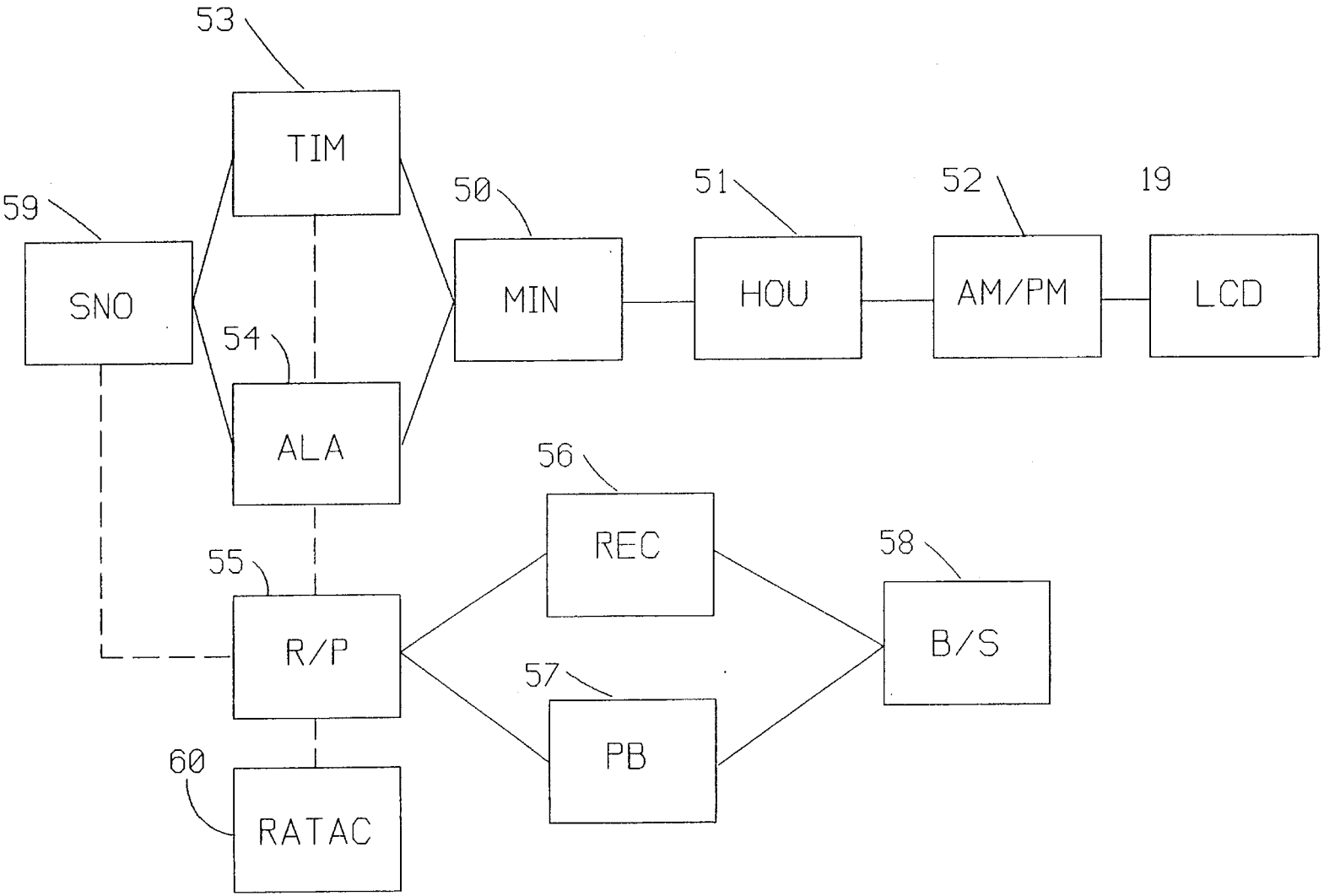
FIG. 2 is a block diagram of the registers present in the microprocessor showing their interrelationship.

Referring now to FIG. 2, all of the storage registers are shown in block chart form. The present invention uses a standard 32.768 Khz crystal 17 as an accurate time base. If the frequency of the crystal is divided by two many times, one highly accurate second of time may be derived. To obtain an accurate clock, these second intervals are added and stored in a minute register 50 within microprocessor 18. As the minute register exceeds 59, the hour register 51 is updated by one. Once the hour register exceeds 11, either the AM/PM register 52 is toggled to PM if already set to AM, or it is toggled to AM if it was set to PM, and accordingly, the appropriate display function on LCD 19 is toggled in turn. All of these aforementioned registers are located entirely within microprocessor 18.

LCD 19 is controlled and driven entirely by microprocessor 18 to display the appropriate time and alarm settings. The microprocessor is provided with sufficient input/output pins to handle the appropriate number of common (row) and segment (column) drivers. The common and segment signals are industry standard and follow the prescribed voltage levels to provide for normal contrast and brightness under standard conditions, although it is also anticipated that the microprocessor 18 can be used to control a variety of contrast and brightness selections.

Both the time register 53 and the alarm register 54 are set by pressing on a set NO (normally open) switch. The time switch is shown at 10 in FIG. 1 and the alarm switch is shown at 15 in FIG. 1. The microprocessor 18, which is in a sleep mode to conserve batteries, is interrupted by the keying action and engages a software "key debounce" routine, then engages in a software "switch lookup" routine in order to determine which switch was engaged. Once it has been determined that either the time or alarm key has been depressed, the microprocessor jumps to another software routine that beings the time or alarm setting function.

The microprocessor 18 software routine then waits for an hour switch 11 or minute switch 12 to be engaged before beginning to update the appropriate time register 53 or alarm register 54, after first debouncing the mechanical switch input and jumping to a "switch lookup" routine, until either the alarm switch 11 or the time switch 12 has been disengaged. This value then becomes either the new time value or the new alarm value which is stored accordingly in either time register 53 or alarm register 54. If either switch is not pressed, then either the time or the alarm time is displayed, depending upon the setting of the time switch 10 or alarm switch 15.

Recording is accomplished by toggling the record/playback switch 13 which is a NO switch. To begin recording, the record/playback switch 13 is held down for approximately ½ second (or other convenient preset value.) The microprocessor 18 engages in a switch interrupt and lookup routine after which it begins a ½ second (or other preferred) count. If the time has been exceeded, then recording begins into voice storage unit 23 shown in FIG. 1, for a present number of seconds, generally between 10 and 16 (or other preferred time interval). If the ½ second not exceeded, then playback begins by triggering the playback register 57 to playback the contents of the record/playback register 55.

The processing of a digitized signal into and out of the voice storage unit 23 is completely controlled by the microprocessor 18, and address selection rates may be set from 8 K bit/sec to 16 K bit/sec (or other preferred rate as set by the microprocessor) depending upon total memory capacity of the voice storage unit 23 and the tonal quality of recording desired.

The microprocessor 18 then waits for a busy signal 58 from either the record register 56 or the playback register 57. After this occurs, the record/playback process can begin again. The microprocessor will turn off until a busy signal from either the record register 56 or the playback register 57 interrupts the microprocessor 18 from sleep mode. When this happens, an error will sound an alarm or flash the LCD display. The microprocessor 18 will not record until the busy signal has been deactivated.

After the alarm register 54 and time register 53 have set and the alarm switch 15 is set to "on", then the alarm function is engaged in microprocessor 18 and a software routine begins comparing, on a minute-by-minute basis, both the alarm register 54 and the time register 55 for hours and minutes. After a coincidence condition is detected between the alarm register 54 and time register 55, the software routine will engage the voice storage unit 23 into play mode for approximately 16 seconds (or other interval as convenient and set by the microprocessor software), repeating every five seconds until either the snooze switch 14 or alarm switch 15 (both shown in FIG. 1) has been engaged.

Snooze switch 14 triggers the snooze software subroutine in microprocessor 18. A snooze register 59 stores a value seven minutes (or other preferred value) ahead of the current time stored in time register 53. The software then checks for a coincidence condition between the snooze register 59 and time register 53. After a coincidence condition is detected, the alarm is triggered by microprocessor 18 and playback begins from voice storage unit 23.

By using microprocessor 18, a wide variety of tones and tonal variations can also be incorporated into the present invention and be substituted for, or used in conjunction with the playback of a voice or other audible sound. Upon engaging the RATAC switch 16, a NO (normally open) switch for a recordable audible tone, when the alarm register 54 or snooze register 59 detects a coincidence condition with the time register 53, a software routine in microprocessor 18 will vary the output of a given number of input/output pin levels to produce a tone or series of tones from the RATAC register 60. This signal is written directly to the speaker 27 (shown in FIG. 1). An analog switch 26 is provided to separate the voice and tone signals.

External microphone 20 is provided to convert the voice signal input to an electronic analog facsimile. Low pass filter 21 is provided to avoid aliasing and signal intrusion. Amplifier 22 is provided to boost the low signal output from microphone 20. With regard to the processed signal output from the microprocessor 18, a low pass filter 25 and an amplifier 24 are used for similar reasons. Further, a speaker 27 is used to transduce an analog voice/sound signal to voice or sound intelligible by the ear.

The combination of elements shown in FIG. 1 which process, store, and produce the voice/audio facsimile, namely, microphone 20, low pass filter 21, amplifier 22, voice storage unit 23, amplifier 24, low pass filter 25, analog switch 26 and speaker 27, can all be combined in a very large scale integration circuitry, so as to permit the use of a singular component within the electronic timepiece.

It should be noted that it is anticipated that microprocessor 18 will utilize a software debounce routine for all switch inputs along with a switch lookup routine. Such routines are commonplace in the industry. A debounce routine allows for a switch to settle before the next software subroutine is called. The switch lookup routine allows the microprocessor 18 to detect which switch was toggled to allow for further subroutine processing.

These and other embodiments and variations are anticipated from the foregoing detailed description of the drawings and the detailed discussion of best method for use of the present invention.

What is claimed is:

1. A recording/reproducing electronic timepiece having a crystal generating a high frequency standard signal, a divider circuit dividing said standard signal to lower frequency signals, key input means for inputting digital data, input means for receiving an audible signal, output means for generating a facsimile of an audible signal, memory means for storing digital data, input amplification and filtering means for processing the audible sounds transferred through the input means into sequential digital signals for storage into the memory means, and output amplification and filtering means for processing the digital signals from storage out to the output means, at least one alarm regster capable of receiving keyed input for setting an alarm time, a time register capable of receiving keyed input for setting the current time, switch means for setting the alarm circuit on, the improvement therein comprising:

microprocessor means for internally selecting memory addresses in the microprocessor memory in sequence for storage such that the selection of memory may be adjusted, inputting the digital signals into memory, selecting a rate for address selection into and out of the memory means such that quality of the audible signal stored may be adjusted, controlling the key input means, providing the timekeeping means to be performed within said microprocessor means, thereby providing an unlimited amount of flexibility in the LCD display and providing a variable input/output rate into memory storage suitable to the available memory and varying the record/playback times, wherein when said switch means is set to on, the microprocessor means is adapted to compare an alarm register to the time register until a coincidence condition is detected whereupon the microprocessor will trigger playback of digital signals stored in the memory means through the output amplification and filtering means to the output means for transformance of the digital signals into an audible facsimile of the original input signal.

2. The apparatus of claim 1 further having a snooze circuit within said microprocessor means for retriggering the alarm circuit at a period rate comprising;

a snooze register set;

a switch means for setting the snooze circuit on;

wherein when said switch means is set to on, the microprocessor means is adapted to set the snooze register a predetermined number of minutes ahead of the current time and then compare the snooze register set to the current time register until a coincidence condition is detected whereupon the microprocessor will trigger the playback of digital signals stored in the memory means at an adjustable rate through the amplification and filtering means to the output means for transformance into a facsimile of the original input signal.

3. The apparatus of claim 1 wherein the input means is a microphone.

4. The apparatus of claim 1 wherein the output means is a speaker.

5. The apparatus of claim 1 wherein the storage means and input and output amplification and filtering means is a very large scale integration circuit.

6. The apparatus of claim 1 further having an analog switch and a recordable analog tone switch wherein when the recordable analog tone switch is set on the microprocessor generates a an audible tone which the analog switch can separate from the digital signals output from the memory means.

* * * * *